US009486936B2

(12) United States Patent
Owens

(10) Patent No.: US 9,486,936 B2
(45) Date of Patent: Nov. 8, 2016

(54) AUTOMATED RIP FENCE FOR ROUTER TABLE

(71) Applicant: Timothy Owens, Holland, OH (US)

(72) Inventor: Timothy Owens, Holland, OH (US)

( * ) Notice: Subject to any disclaimer, the term of this patent is extended or adjusted under 35 U.S.C. 154(b) by 616 days.

(21) Appl. No.: 13/947,725

(22) Filed: Jul. 22, 2013

(65) Prior Publication Data

US 2015/0020922 A1 Jan. 22, 2015

(51) Int. Cl.
*B27C 5/04* (2006.01)
*B27B 27/10* (2006.01)

(52) U.S. Cl.
CPC *B27C 5/04* (2013.01); *B27B 27/10* (2013.01)

(58) Field of Classification Search
CPC ..... B27C 5/04; B27B 27/00; B27B 27/02; B27B 27/04; B27B 27/06; B27B 27/08; B27B 27/10; B25B 1/00; B25B 3/00; B25B 5/00
USPC ..... 269/291
See application file for complete search history.

(56) References Cited

U.S. PATENT DOCUMENTS 5,215,296 A * 6/1993 Adams ..... B23Q 5/406 269/181
5,251,142 A * 10/1993 Cramer ..... B23D 59/008 700/171
5,524,514 A * 6/1996 Hadaway ..... B23D 47/02 269/303
5,553,644 A * 9/1996 Adams ..... B23Q 16/006 144/135.2
5,779,407 A * 7/1998 Tucker ..... B23Q 3/002 144/252.1
6,918,329 B2 * 7/2005 Dick ..... B23D 47/04 83/440
7,574,949 B2 * 8/2009 Hadaway ..... B27B 27/10 83/446
7,997,312 B2 * 8/2011 Van Valkenburg ..... B27C 5/04 144/137
9,221,188 B1 * 12/2015 Wisen ..... B27B 27/10
2003/0145705 A1 * 8/2003 Miller ..... B23Q 3/007 83/468
2003/0151589 A1 * 8/2003 Bensen ..... G06F 3/0414 345/156
2004/0255705 A1 * 12/2004 Sullivan ..... B23Q 5/40 74/89.33
2005/0027389 A1 * 2/2005 Hadaway ..... B27B 27/10 700/159
2005/0167000 A1 * 8/2005 Dick ..... B27B 27/02 144/253.1
2006/0086222 A1 * 4/2006 Dick ..... B23D 47/04 83/438
2010/0071521 A1 * 3/2010 Hadaway ..... B23D 45/06 83/76.1
2013/0269835 A1 * 10/2013 Yu ..... B27C 5/04 144/253.6

OTHER PUBLICATIONS

Next Wave Automation, Ready2Rout Nov. 3, 2014, webpage: http://shop.nextwaveautomation.com/shop/item.aspx?itemid=130.*
NOOK, Linear Guidance Catalog 2013, 1 st Edition, pp. 184-186.*

* cited by examiner

*Primary Examiner* — Matthew G Katcoff
(74) *Attorney, Agent, or Firm* — Shumaker, Loop & Kendrick, LLP

(57) ABSTRACT

An automated fence for being installed on a router table and including a plate for being fixed to a top surface of the table and a carriage movable relative to the plate, the carriage including spaced brackets, a fence, spaced rods interconnecting the brackets, the rods being slidable within bearing sleeves attached to the plate, a threaded rod attached to a motor for driving rotation of the threaded rod and the threaded rod being received within an internally threaded opening of a bracket fixed to the plate, a housing and a controller for actuating the motor.

20 Claims, 7 Drawing Sheets

AUTOMATED RIP FENCE FOR ROUTER TABLE

TECHNICAL FIELD AND BACKGROUND OF THE INVENTION

The present invention relates generally to an automated fence positioning system, and more particularly, to a universal, tabletop-mounted automated fence for a router table including a digital controller, dust free housing and vacuum attachment port, among other features and advantages.

Inverted router tables are well known and generally include a router rigidly mounted to the underside of a flat table such that the cutter or "bit" protrudes upward through a hole in the table. Material is fed into the cutter and maintained against an adjustable rip fence for material control and safe operation. Most rip fences are manually adjustable, and thus are cumbersome to operate, time consuming to adjust, and inaccurate in their positioning.

In an effort to improve accuracy and speed adjustment time, systems have been developed for automating the movement of table fences. Most systems typically require positioning a motor-driven carriage alongside an edge of the table, and attaching the carriage to one end of the fence. Movement of the fence is achieved by driving the carriage along a rail or like guide. While such systems are an improvement over manually adjustable systems in terms of speed of operation, such systems are disadvantageous in terms of the increased footprint of the table from the addition of the system, and tendency of the fence supported at one end to move out of square, particularly under force and/or where the fence has a relatively long length. Such side-mounted systems are also exposed alongside the table, and thus are susceptible to impact and damage that may require repair and realignment. Maintaining a square rip fence is important for accuracy, and critically important when adjusting the fence between small intervals.

Accordingly, what is needed is an improved automated fence for a router table that overcomes the disadvantages of prior art systems, as well as provides the additional advantages of improved accuracy of adjustment, protection from impact, universal attachment and vacuum connection, among other advantages.

BRIEF SUMMARY OF THE INVENTION

To achieve the foregoing and other aspects and advantages, in a first embodiment provided herein is an automated rip fence configured to be installed on the top of a router table. The automated rip fence includes a plate configured to be fixed to a top surface of a router table, and a carriage horizontally movable relative to the plate. The carriage includes spaced first and second brackets, the first bracket having a fence attached thereto and the second bracket supporting a motor, spaced first and second rods interconnecting the first and second brackets, the first and second rods slidable within bearing sleeves attached to the plate, a threaded rod attached to the motor through the second bracket, the motor driving rotation of the threaded rod and the threaded rod being received within an internally threaded opening of a third bracket fixed to the plate, a housing covering a top and sides of the carriage, and a controller for actuating the motor.

In a further embodiment, the fence has an opening therethrough for being positioned around a router cutter.

In a further embodiment, the first bracket has an opening therethrough for being positioned around the router cutter, and the opening through the first bracket and the opening through the fence being aligned.

In a further embodiment, the housing includes an opening therethrough positioned near the cutter and adapted to receiving a vacuum hose.

In a further embodiment, a chute is positioned adjacent the opening through the housing for directing dust and vacuum through the opening.

In a further embodiment, the controller includes a touch-screen display carried in the housing.

In a further embodiment, the threaded rod turns in a first direction to move the carriage in a first direction relative to the plate, and the threaded rod turns in a second, opposite direction to move the carriage in a second, opposite direction relative to the plate.

In a further embodiment, the controller includes a display configured to display units in one or more of English units, metric units and fractions.

In a further embodiment, the controller includes a processor and memory for saving and storing fence positions.

In a further embodiment, the plate includes a plurality of elongate slots therethrough for receiving one or more fasteners for fixing the plate to a router table.

In a further embodiment, the carriage includes a USB port for uploading and downloading data to and from the controller.

Additional features, aspects and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION OF THE INVENTION

Figure 1:
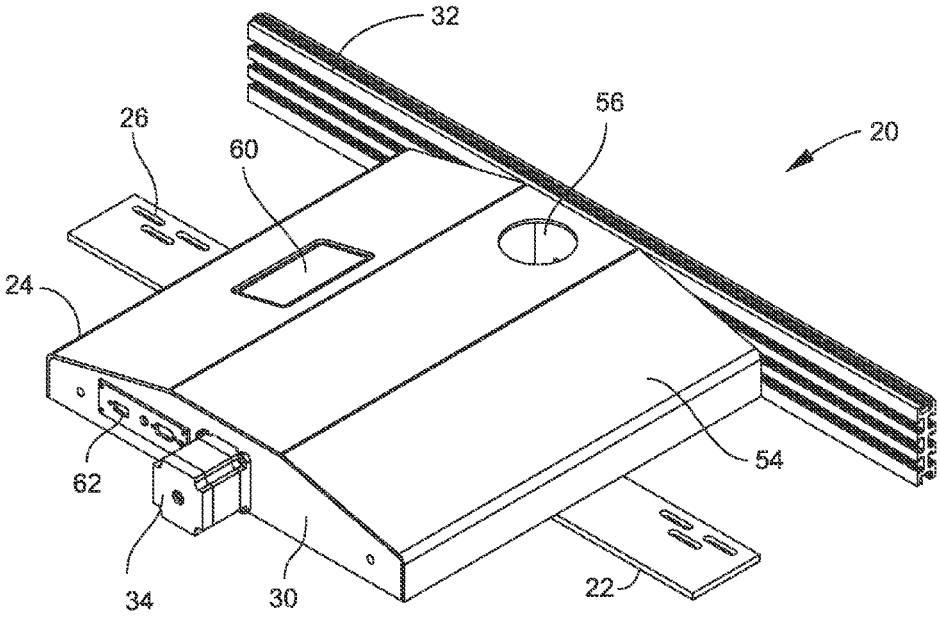
FIG. 1 is a top isometric view of an automated fence according to an embodiment of the invention.
Figure 2:
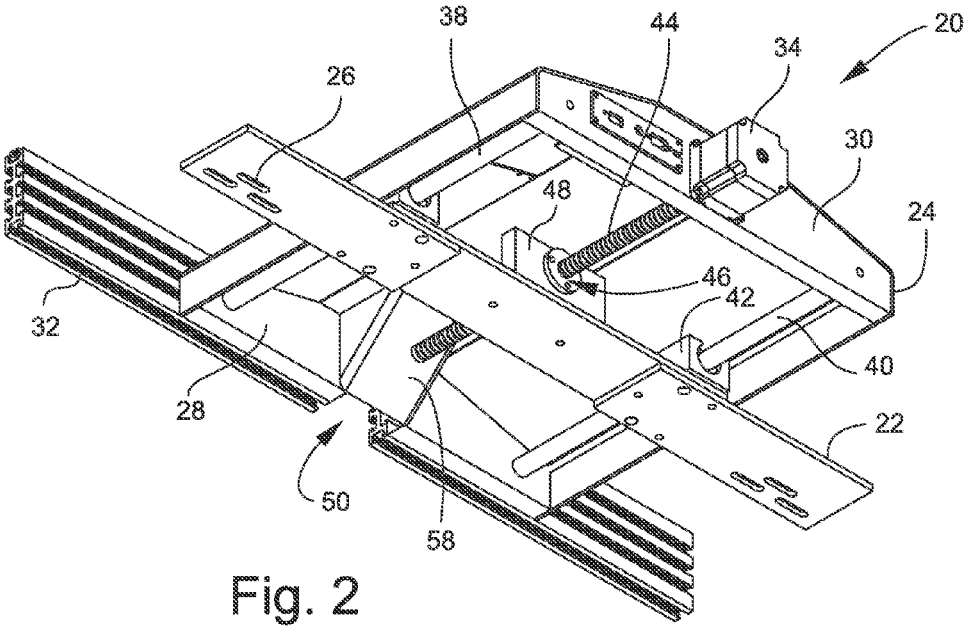
FIG. 2 is a bottom isometric view of the automated fence.

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

Referring to FIGS. 1-10, an automated fence system for use with a router table is shown generally at reference numeral 20. The automated fence 20 is configured to attach to the top surface of a router table with the cutter or bit of the router generally positioned along an axis bisecting the housing. The automated fence 20 in configured for universal attachment, and thus may be used with most router tables. Slight modification may be made to the attachment plate to accommodate certain tables, and such modification is within one or ordinary skill in the art. The automated fence is not limited to use with router tables and may be used with other woodworking and power tools, among other applications.

The automated fence 20 generally includes a plate 22 for attaching the system to a top surface of a router table, and a carriage 24 horizontally movable relative to the plate. The plate 22 may be a unitary member or made up of sections for ease of packaging. The plate 22 is secured or fixed to the top surface of the table with the lower major face of the plate facing the tabletop and seating flush thereon. Once attached, the plate 22 is fixed in position such that there is no relative motion between the plate 22 and tabletop. The plate may be attached to the tabletop using one or more fasteners, such as screws or bolts. The fasteners are received through elongate slots 26 through the plate that align with threaded openings in the tabletop. The slots 26 are elongate and multiple slots are provided to provide various mounting positions and freedom of adjustment to provide a universal automated fence.

The carriage 24 is movably attached to the plate 22 and generally includes spaced first and second brackets 28, 30, with the first bracket 28 having a fence 32 attached thereto and the second bracket 30 supporting a motor 34 and portions of a controller. The brackets 28, 20 are interconnected by spaced first and second parallel rods 38, 40. The rods 38, 40 are arranged perpendicular to the brackets 28, 30, thus keeping the frame square. The rods 38, 40 are slidable within bearing sleeves 42 attached to the plate 22.

A threaded rod 44 is coupled to the motor through the second bracket 30. The externally threaded rod 44 is threadably engaged within an internally threaded opening 46 of a bracket 48 secured at about the center of the plate 22. When the motor 34 is actuated, the threaded rod 44 turns to move the carriage relative to the plate, and thus the tabletop. The threaded rod 44 is turned in a first direction to move the carriage 24 toward the cutter, and in a second, opposite direction to move the carriage 24 away from the cutter. The carriage is thus horizontally movable relative to the cutter in order to selectively position the attached rip fence 32 relative to the cutter.

The threaded rod 44 is positioned between the spaced rods 38, 30. The three points of engagement between the carriage 24 and plate 22, i.e., the two bearing sleeves 42 and the center bracket 48, keep the fence 32 square and prevent the fence from twisting under force on either end of the fence.

The fence 32 is an elongate linear member that may be continuous or made up of sections for ease of packaging. As shown, the fence 32 is an extruded member, but it should be understood that the fence can be constructed from any material and in any manner. The fence is preferably rigid and resists bending under typical amounts of force. Material is fed into the cutter and maintained against the adjustable fence 32 for material control and safe operation.

Figure 3:
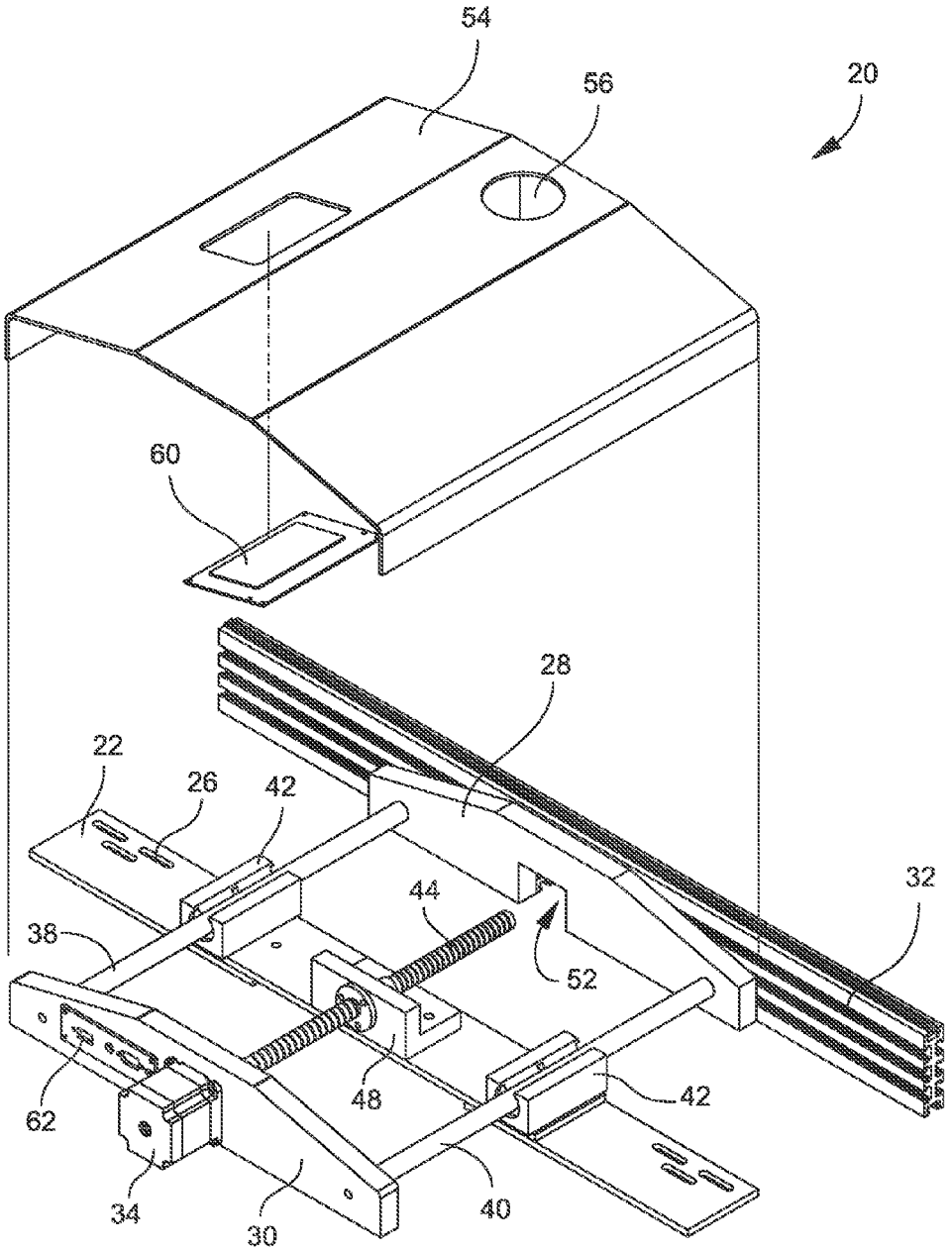
FIG. 3 is an exploded view of the automated fence.
Figure 4:
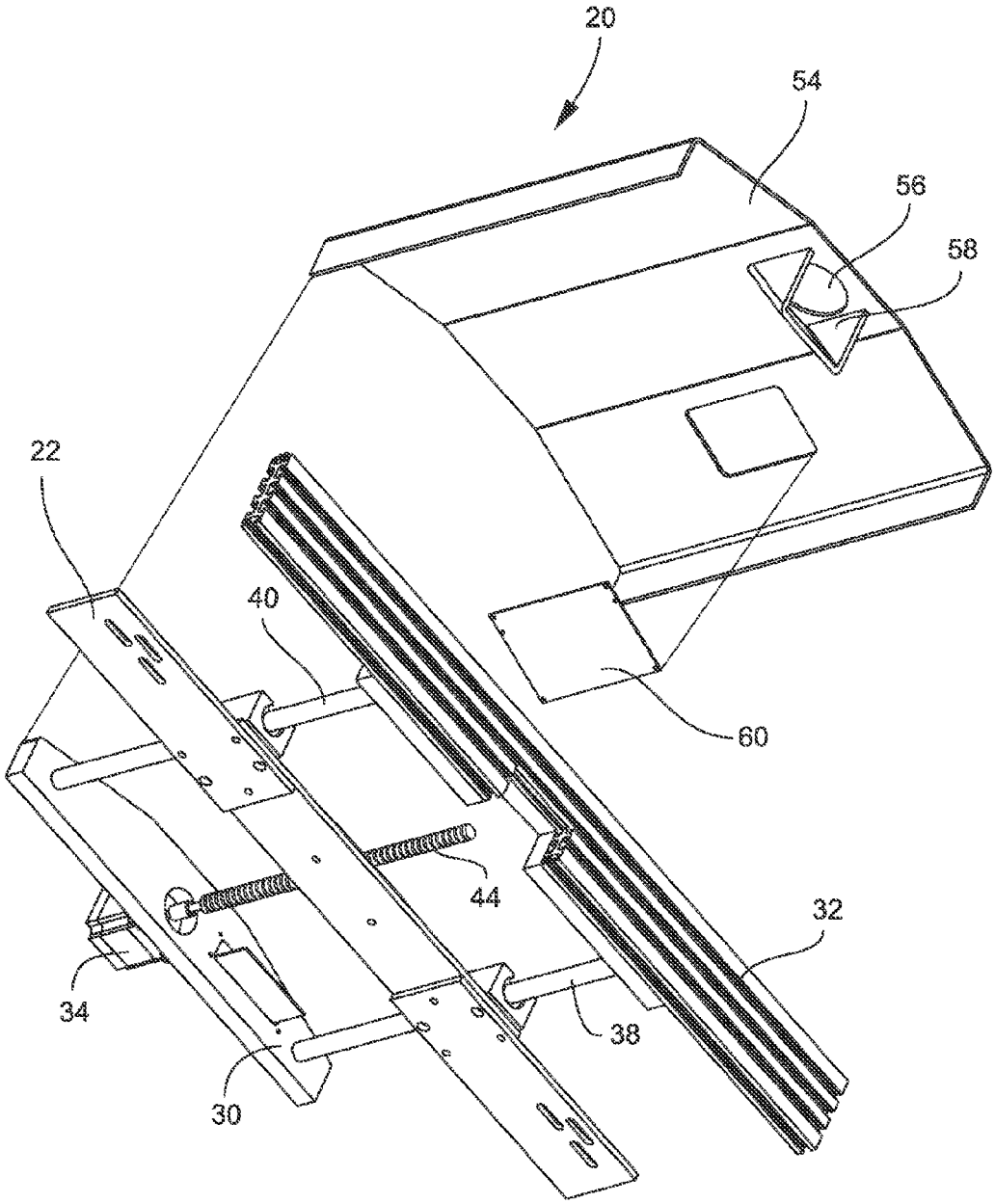
FIG. 4 is another exploded view of the automated fence.
Figure 5:
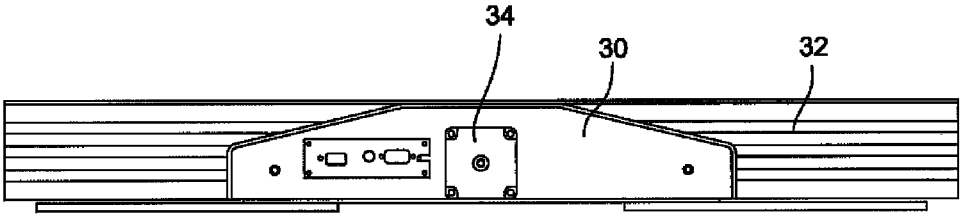
FIG. 5 is a back elevation view of the automated fence.
Figure 6:
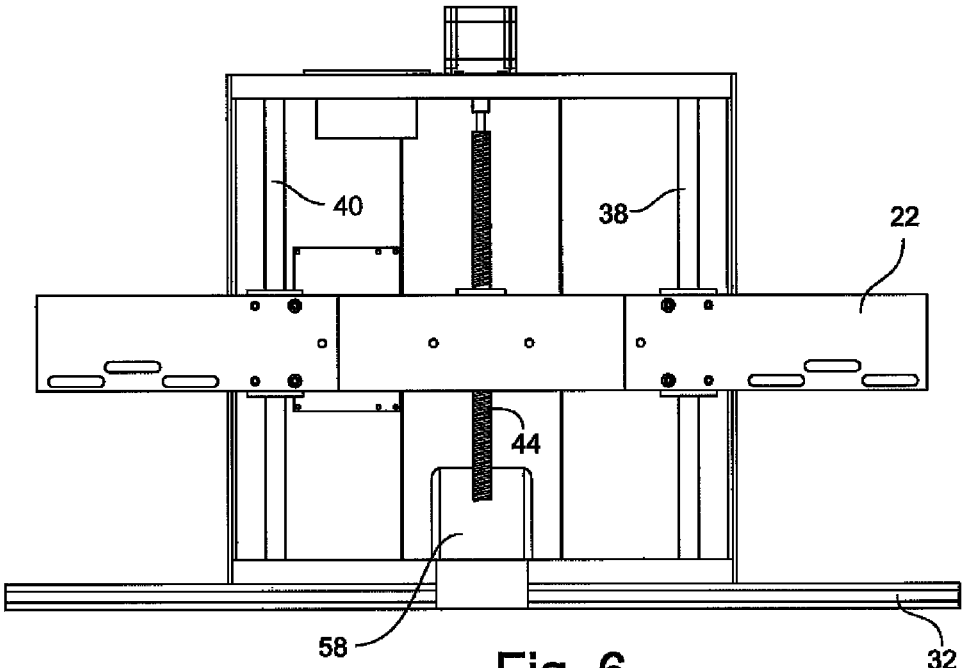
FIG. 6 is a bottom plan view of the automated fence.
Figure 7:
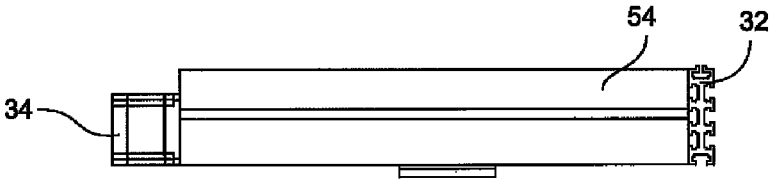
FIG. 7 is a side elevation view of the automated fence.
Figure 8:
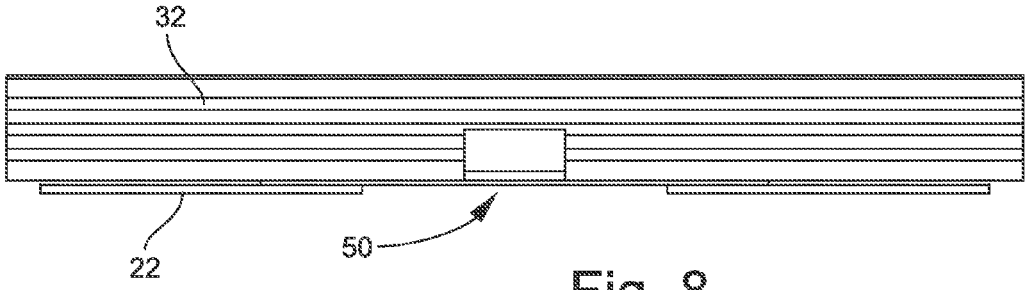
FIG. 8 is a front elevation view of the automated fence.
Figure 9:
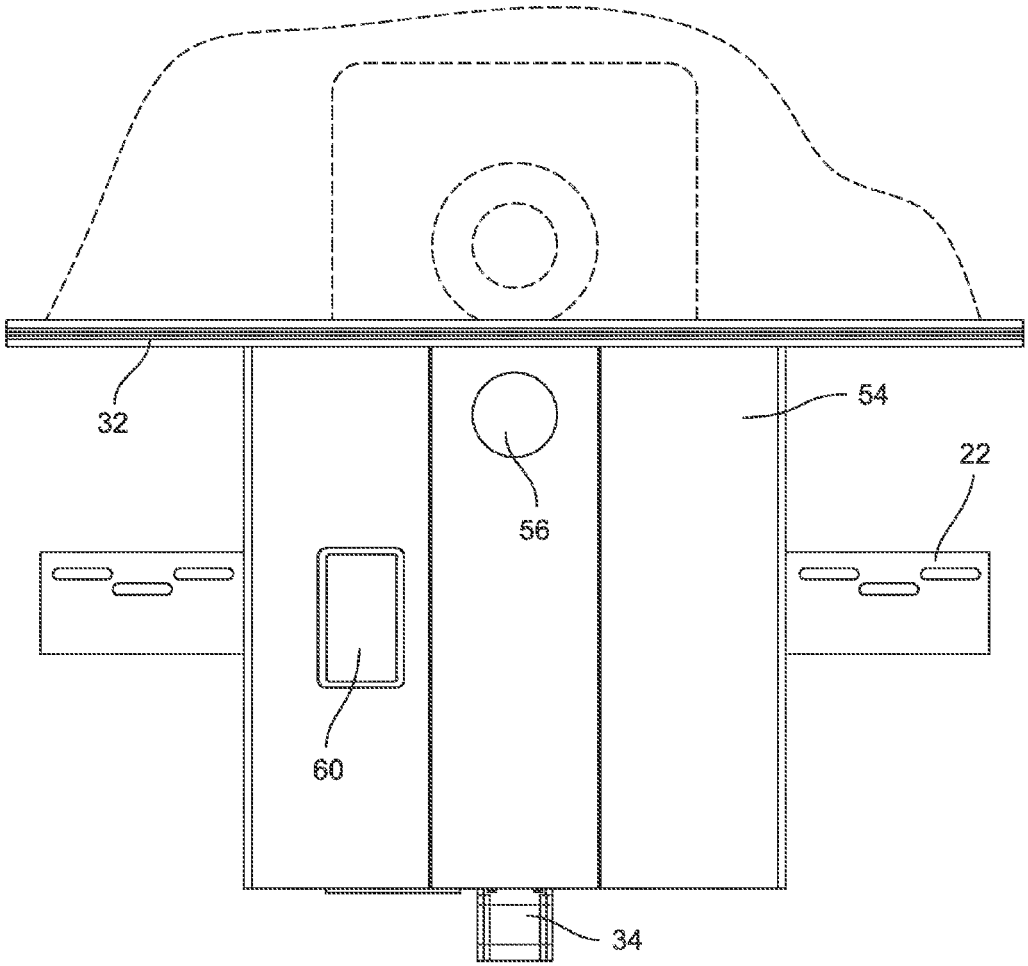
FIG. 9 is a top plan view of the automated fence.
Figure 10:
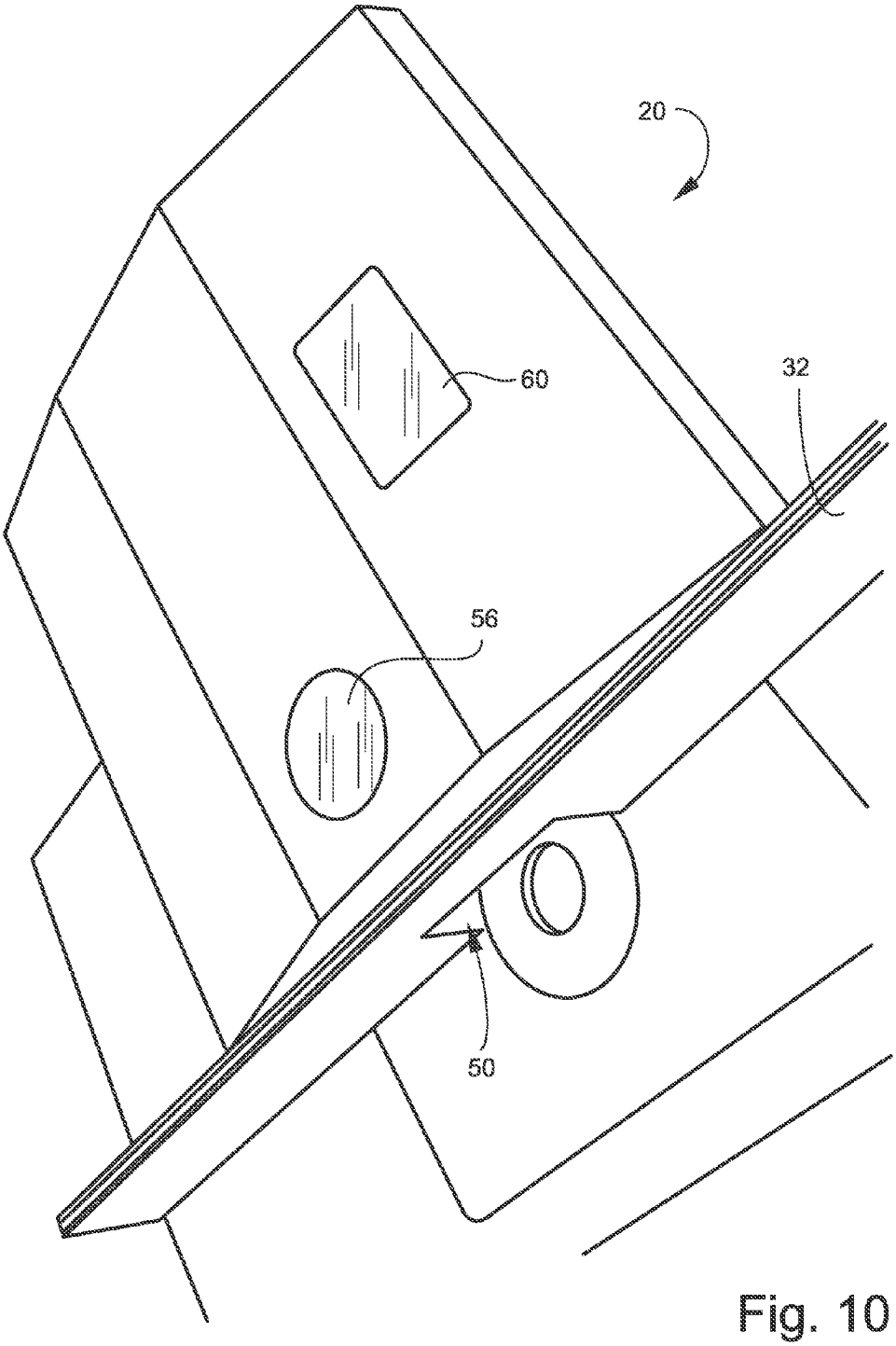
FIG. 10 is a perspective view showing the automated fence installed on a router table.

As best shown in FIGS. 3, 4 and 8, the fence 32 has an opening 50 therethrough for allowing the fence to be positioned over the cutter. The fence 32 is horizontally adjustable by way of movement of the carriage 24 to expose or cover portions of the cutter. The first bracket 28 also includes an opening 52 therethrough aligned with the opening 50 through the fence 32. The aligned openings not only provide clearance for the cutter, but a vacuum and dust pathway for collecting debris as described below.

The carriage assembly is substantially covered on the top and sides by a housing 54. The housing 54 may be made from plastic or other material. The housing 54 secures over the brackets 28, 30 and maintains the underlying rods 38, 40, bearing sleeves 42, threaded rod 44 and bracket 48 in a substantially dust-free environment, ensuring smooth and continued operation. The housing 54 further includes a port 56 positioned adjacent the cutter. The port 56 is adapted to receive a vacuum hose therethrough or attach a vacuum hose thereto for collecting debris and dust. As best shown in FIG. 4, a chute 58 is provided beneath the port 56 for directing the flow of vacuum and debris from the cutter to the port 56. The openings through the fence 32 and first bracket 28 provide a vacuum pathway.

The housing 54 further supports a controller 60, which in the preferred embodiment is a touchscreen display including a processor and memory for motor control, storing fence positions, etc. The controller 60 is secured to the underside of the housing 54 and prominently displayed to a user through an opening in the housing. A seal may be provided between the controller 60 and housing 54 for preventing uncollected dust from passing therebetween.

The controller 60 may be a conventional Programmable Logic Controller (PLC) known to those skilled in the art. The PLC receives outputs from the touchscreen panel and sends control signals to the motor controller, which in turn controls the motor. The controller 60 may include a Dynamic Link Library (DLL) that stores fence positions and cutter configurations in memory for use by the controller. Fence positions may be set by the user or set automatically when a certain cutter configuration is used. The system further includes a touch-off plate known to those skilled in the art for zeroing the device between bit changes. The touch-off plate is used to obtain the reference off the bit from the fence. In one embodiment, the controller may be instructed to move the plate into contact with the bit, registering the point of contact as zero and calculating distances based on this reference point. In another embodiment, the touch-off plate is plugged into the back of the unit, a magnet attaches to the bit and the plate is placed between the bit and the fence in a vertical orientation.

Figure 11:
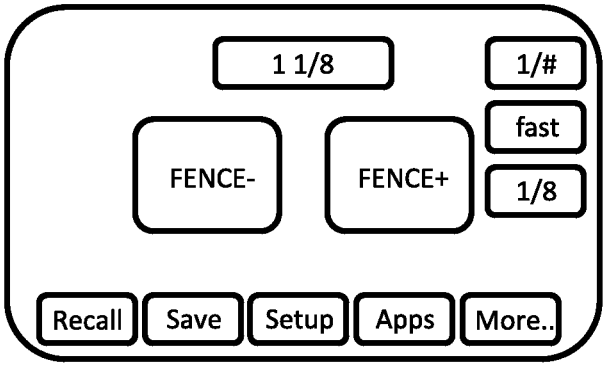
FIG. 11 is an exemplary display and control screen for controlling the automated fence.

Referring to FIG. 11, an exemplary touchscreen display for controlling the automated fence is shown. The display may include a position readout that displays the current position of the fence. Soft keys may be used to move the fence toward or away from the cutter. Units may be displayed in one or more of English units, Metric units and fractions. Motor speed may also be controlled and adjusted. Fence positions may be rounded to a smallest predetermined increment. The fence 32 may be moved in predetermined increments by actuating a soft key, for example, ¼ inch, ½ inch, ⅛ inch, 0.25 inches, etc.

Figure 12:
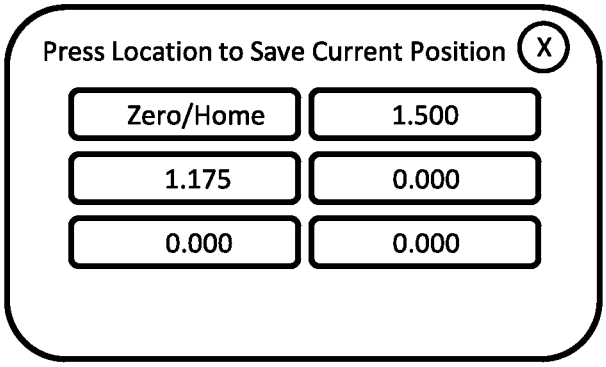
FIG. 12 is an exemplary display and control screen for saving current positions and/or recalling positions.

Referring to FIG. 12, the controller includes memory and functionality for saving current positions and recalling positions. Exemplary positions may include 'zero/home' and various other positions that may be user-set memory positions. The controller may also allow for direct entry of positioned information, which offers the added benefit of a calculator making complex changes to current positions easier.

Figure 13:
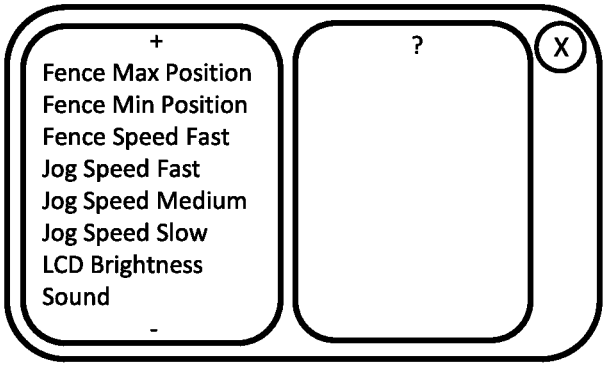
FIG. 13 is an exemplary display and control screen for system setup.

Referring to FIG. 13, the controller may include a display screen for setup. The controller may also include an abort button for emergency stops. The system setup screen allows the user to adjust system parameters and preferences. Exemplary parameters are shown in the left-hand side of the screen. The right-hand side of the screen may be reserved for editing the selected parameter. Once a parameter is selected, a graphical image may visually display the depicted item. The controller further includes a USB port 62 or like port for downloading and uploading data to the controller 60. Wiring and cabling between the controller portion located within the housing 54 and the portion supported by bracket 30 is not shown for clarity, although one skilled in the art would understand there to be an electrical and communications link therebetween. Power may be connected adjacent the USB connection.

The foregoing description provides embodiments of the invention by way of example only. It is envisioned that other embodiments may perform similar functions and/or achieve similar results. Any and all such equivalent embodiments and examples are within the scope of the present invention and are intended to be covered by the appended claims.

What is claimed is:

1. An automated fence adapted to be installed atop a router table, comprising:

(a) a plate configured to be fixed to a top surface of a router table; and (b) a carriage horizontally movable relative to the plate, the carriage comprising:

(i) spaced first and second brackets, the first bracket having a fence attached thereto and the second bracket supporting a motor;

(ii) spaced first and second rods interconnecting the first and second brackets, the first and second rods slidable within bearing sleeves attached to the plate;

(iii) a threaded rod attached to the motor through the second bracket, the motor driving rotation of the threaded rod and the threaded rod being received within an internally threaded opening of a third bracket fixed to the plate;

(iv) a housing covering a top and sides of the carriage, the housing secured to the first and second brackets and concealing the first and second rods, the bearing sleeves, and the third bracket beneath the cover; and (v) a controller for actuating the motor;

wherein the plate is static and the carriage horizontally translates as a single unit relative to the plate to move the fence toward or apart from a cutter atop the router table; and wherein the plate and the carriage are positioned atop the router table entirely to one side of the cutter.

2. The automated fence of claim 1, wherein the fence has an opening therethrough for being positioned around the cutter.

3. The automated fence of claim 2, wherein the first bracket has an opening therethrough for being positioned around the cutter, wherein the opening through the first bracket and the opening through the fence are aligned.

4. The automated fence of claim 3, wherein the housing includes an opening therethrough positioned near the opening through the first bracket, the opening through the housing adapted to attach a vacuum hose.

5. The automated fence of claim 4, further comprising a chute positioned adjacent the opening through the housing for directing a flow of suction from the vacuum hose.

6. The automated fence of claim 1, wherein the controller includes a touchscreen display carried in the housing.

7. The automated fence of claim 1, wherein the threaded rod turns in a first direction to move the carriage in a first direction relative to the plate, and the threaded rod turns in a second, opposite direction to move the carriage in a second, opposite direction relative to the plate.

8. The automated fence of claim 1, wherein the controller includes a display configured to display units in one or more of English units, Metric units and fractions.

9. The automated fence of claim 1, wherein the controller includes a processor and memory for saving and storing fence positions.

10. The automated fence of claim 1, wherein the plate includes a plurality of elongate slots therethrough for receiving one or more fasteners for fixing the plate to the router table.

11. The automated fence of claim 1, further comprising a USB port for uploading and downloading data to and from the controller.

12. An automated fence adapted to be installed atop a router table, comprising:

(a) a plate configured to be fixed to a top surface of a router table; and (b) a carriage movable relative to the plate, the carriage comprising:

(i) a bracket supporting a motor;

(ii) a fence spaced apart from the bracket;

(ii) spaced first and second rods interconnecting the bracket and the fence, the first and second rods slidable within bearing sleeves attached to the plate;

(iii) a threaded rod attached to the motor through the bracket, the motor driving rotation of the threaded rod and the threaded rod being received within an internally threaded opening of a bracket fixed to the plate;

(iv) a housing secured to the bracket and fence and covering the threaded rod and first and second rods; and (v) a controller for actuating the motor;

wherein the plate is static and the carriage horizontally translates as a single unit relative to the plate to move the fence toward or apart from a cutter atop the router table; and wherein the plate and the carriage are positioned atop the router table entirely to one side of the cutter.

13. The automated fence of claim 12, wherein the fence has an opening therethrough for being positioned around the cutter.

14. The automated fence of claim 12, wherein the housing includes an opening therethrough adapted to attach a vacuum hose.

15. The automated fence of claim 14, further comprising a chute positioned adjacent the opening for directing a flow of suction from the vacuum hose.

16. The automated fence of claim 12, wherein the controller includes a display screen carried by the housing, the display screen including touchscreen functionality.

17. The automated fence of claim 12, wherein the threaded rod turns in a first direction to move the carriage in a first direction relative to the plate, and the threaded rod tunes in a second, opposite direction to move the carriage in a second, opposite direction relative to the plate.

18. The automated fence of claim 12, wherein the controller includes a display configured to display units in one or more of English units, metric units and fractions.

19. The automated fence of claim 12, wherein the controller includes a processor and memory for saving and storing fence positions.

20. The automated fence of claim 12, wherein the plate includes a plurality of elongate slots therethrough for receiving one or more fasteners for fixing the plate to the router table.

* * * * *